US009522314B2

(12) United States Patent
Timberman

(10) Patent No.: US 9,522,314 B2
(45) Date of Patent: Dec. 20, 2016

(54) GOLF GREEN DIVOT REPAIR TOOL

(71) Applicant: Corelt LLC, Carmel, IN (US)

(72) Inventor: Wayne A. Timberman, Carmel, IN (US)

(73) Assignee: Corelt LLC, Carmel, IN (US)

( * ) Notice: Subject to any disclaimer, the term of this patent is extended or adjusted under 35 U.S.C. 154(b) by 86 days.

(21) Appl. No.: 14/548,442

(22) Filed: Nov. 20, 2014

(65) Prior Publication Data

US 2015/0202507 A1 Jul. 23, 2015

Related U.S. Application Data

(60) Provisional application No. 61/928,955, filed on Jan. 17, 2014.

(51) Int. Cl.
*A63B 57/50* (2015.01)
*A63B 57/00* (2015.01)

(52) U.S. Cl.
CPC ..... *A63B 57/0068* (2013.01); *A63B 57/50* (2015.10)

(58) Field of Classification Search
CPC ..... A63B 57/50; A01B 1/00; A01B 1/16; A01B 1/165
USPC ..... D21/793
See application file for complete search history.

(56) References Cited

U.S. PATENT DOCUMENTS 933,227 A * 9/1909 Billau ..... A01B 1/16 172/377
1,470,284 A * 10/1923 Pooler ..... A01C 5/02 294/50.6
1,540,284 A * 6/1925 Reveny ..... A47J 17/02 294/49
1,551,815 A * 9/1925 Ferguson ..... A47J 23/00 30/113.1
2,057,067 A * 10/1936 Smith ..... A01B 1/165 254/132
2,362,090 A * 11/1944 Peters ..... G01N 1/04 30/115
3,049,182 A 8/1962 Pelow
D230,409 S * 2/1974 Schaffer ..... 473/402
3,866,749 A * 2/1975 Stainer ..... A63B 57/353 206/234
D239,304 S * 3/1976 Jackson ..... D21/793
4,007,928 A * 2/1977 Doubt ..... A47G 25/82 223/118
D308,713 S * 6/1990 Sherry ..... D21/793
(Continued)

OTHER PUBLICATIONS

Notice of Allowance for U.S. Appl. No. 29/509,676, mailed on Jun. 17, 2015, 10 pp.
Toro Titan Tines 2012 catalog, 2012, The Toro Company.

*Primary Examiner* — Steven Wong
(74) *Attorney, Agent, or Firm* — Bell & Manning, LLC

(57) ABSTRACT

A golf green divot repair tool is provided that includes a handle and a tine structure. The tine structure includes a trough wall forming a trough, the trough wall mounted to the handle at a first end of the trough wall, and a tapered wall mounted to extend to a tip from a second end of the trough wall. The second end and the first end are on opposite ends of the trough. A trough cross section is defined in a plane perpendicular to a longitudinal axis that extends from the first end to the second end. The trough cross section is further defined by an open side. The trough wall of the trough cross section is configured to trap soil within the trough wall when inserted in a divot.

19 Claims, 11 Drawing Sheets

(56) References Cited

U.S. PATENT DOCUMENTS

| | | | | | |
|---|---|---|---|---|---|
| D326,212 | S | * | 5/1992 | Mingrino | D8/10 |
| 5,209,534 | A | * | 5/1993 | Crenshaw | A01C 5/02 172/22 |
| 5,322,130 | A | | 6/1994 | Ryden | |
| 5,398,927 | A | | 3/1995 | O'Sullivan | |
| 5,405,133 | A | | 4/1995 | Upton | |
| 5,562,553 | A | | 10/1996 | Digerness et al. | |
| 5,615,744 | A | * | 4/1997 | Krafka | A01B 1/165 172/21 |
| 5,664,819 | A | * | 9/1997 | Conrad | A01B 1/16 172/375 |
| 5,730,226 | A | | 3/1998 | Kendall | |
| 5,759,111 | A | | 6/1998 | Clark | |
| D397,503 | S | * | 8/1998 | Lalli | D21/794 |
| 5,868,206 | A | | 2/1999 | Miller | |
| 6,217,465 | B1 | | 4/2001 | Kenia, Jr. | |
| 6,290,617 | B1 | | 9/2001 | Cole et al. | |
| D456,475 | S | * | 4/2002 | Aldrich | D21/793 |
| 6,505,687 | B1 | | 1/2003 | Wichmann | |
| 6,945,332 | B2 | | 9/2005 | Uehara | |
| 7,004,858 | B2 | | 2/2006 | Bauley et al. | |
| 7,033,288 | B1 | | 4/2006 | Edwards et al. | |
| D526,378 | S | | 8/2006 | Blanks | |
| 7,140,983 | B2 | | 11/2006 | Pietsch | |
| 7,152,691 | B2 | | 12/2006 | Maas et al. | |
| 7,238,126 | B1 | | 7/2007 | Wiens et al. | |
| D554,726 | S | | 11/2007 | Blanks | |
| D580,001 | S | | 11/2008 | McCabe | |
| 7,559,849 | B1 | | 7/2009 | Cuddie | |
| D603,113 | S | * | 10/2009 | Morton | D30/162 |
| 7,874,374 | B2 | | 1/2011 | Gamble | |
| 8,764,587 | B2 | | 7/2014 | Sinanis et al. | |
| 2001/0004019 | A1 | | 6/2001 | Wakefield | |
| 2004/0038755 | A1 | * | 2/2004 | Laux | A63B 57/50 473/408 |
| 2008/0268985 | A1 | * | 10/2008 | Wiens | A63B 57/50 473/408 |
| 2009/0082127 | A1 | | 3/2009 | Donne | |
| 2012/0135817 | A1 | | 5/2012 | Paustenbach | |

* cited by examiner

GOLF GREEN DIVOT REPAIR TOOL

CROSS-REFERENCE TO RELATED APPLICATIONS

The present application claims the benefit of 35 U.S.C. §119(e) to U.S. Provisional Patent Application No. 61/928,955 filed on Jan. 17, 2014.

BACKGROUND

A force of a golf ball impacting a golf putting green can form a depression generally referred to as a divot or ball mark. Grass may be pushed to one side of the depression. The grass growing in or around the depression may be damaged or killed. Additionally, the depression mars the otherwise locally planar surface of the putting green.

SUMMARY

In an example embodiment, a golf green divot repair tool is provided. The golf green divot repair tool includes, but is not limited to, a handle and a tine structure. The tine structure includes, but is not limited to, a trough wall and a tapered wall. The trough wall forms a trough and is mounted to the handle at a first end of the trough wall. The tapered wall is mounted to extend to a tip from a second end of the trough wall. The second end and the first end are on opposite ends of the trough. A trough cross section is defined in a plane perpendicular to a longitudinal axis that extends from the first end to the second end. The trough cross section is further defined by an open side. The trough wall of the trough cross section is configured to trap soil within the trough wall when inserted in a divot In another example embodiment, a method of repairing a divot on a golf green is provided. A golf green divot repair tool is held in a hand using a handle of the golf green divot repair tool. The golf green divot repair tool further includes a tine structure that includes a trough wall forming a trough, the trough wall mounted to the handle at a first end of the trough wall, and a tapered wall mounted to extend to a tip from a second end of the trough wall. The second end and the first end are on opposite ends of the trough. The tip is inserted into a divot on a golf green until the trough wall is at least partially below a surface of the divot. The inserted golf green divot repair tool is rotated to trap soil in the trough wall. The golf green divot repair tool is withdrawn from the divot with the trapped soil. The trapped soil is discarded.

Other principal features of the disclosed subject matter will be apparent to those skilled in the art upon review of the following drawings, the detailed description, and the appended claims.

BRIEF DESCRIPTION OF THE DRAWINGS

Illustrative embodiments of the disclosed subject matter will hereafter be described referring to the accompanying drawings, wherein like numerals denote like elements.

DETAILED DESCRIPTION

Figure 1:
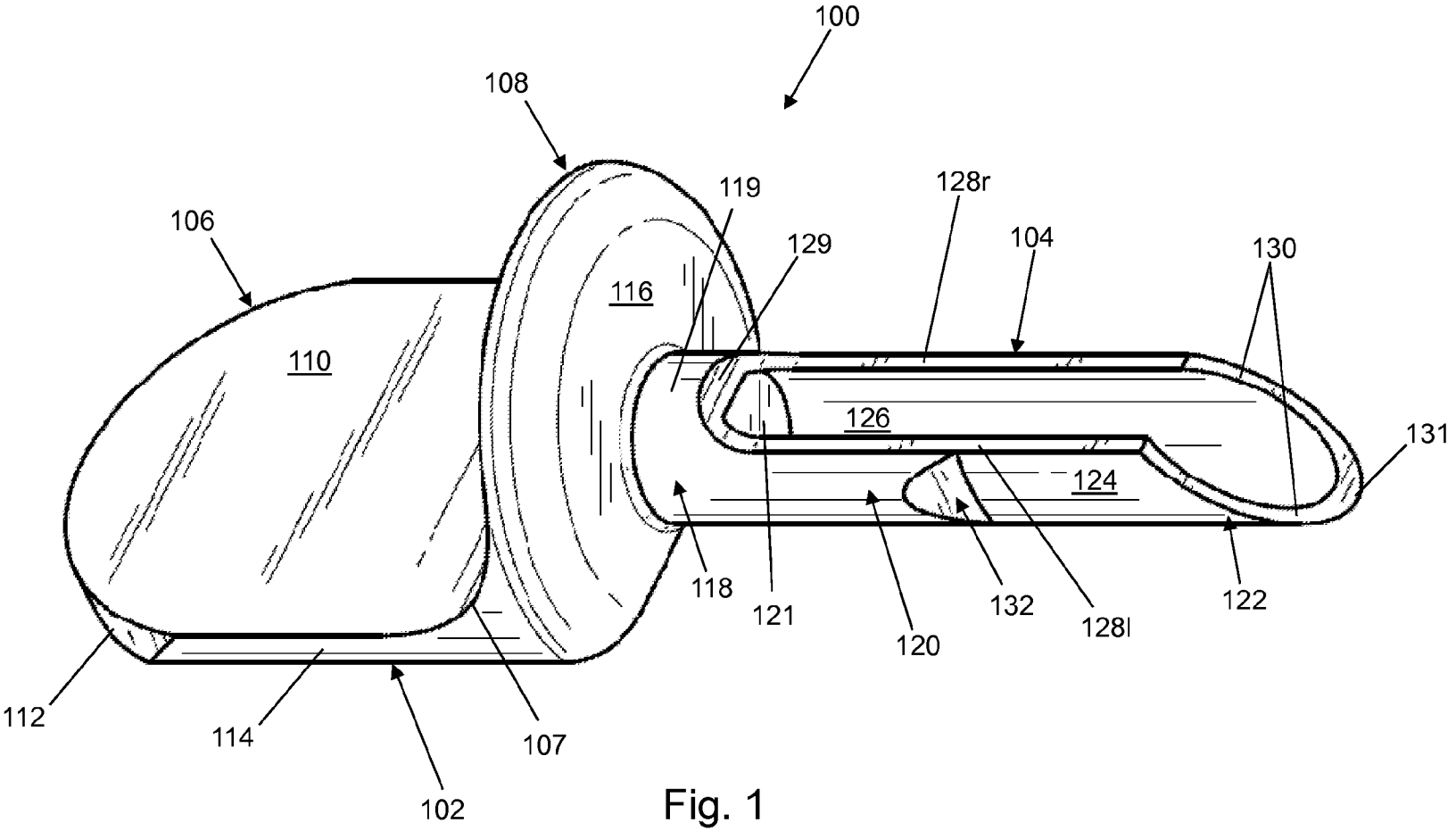
FIG. 1 depicts a front, left perspective view of a divot repair tool in accordance with an illustrative embodiment.

With reference to FIG. 1, a front, left perspective view of a divot repair tool 100 is shown in accordance with an illustrative embodiment. Divot repair tool 100 may include a handle 102 and a tine structure 104. The one or more components of divot repair tool 100 may be formed of one or more materials, such as various metals, elastomeric material, and/or plastics having a sufficient strength and rigidity to support the described application to the repair of divots on a putting green surface. For illustration, handle 102 and tine structure 104 may be formed of a single piece of plastic using a molding process as understood by a person of skill in the art.

Tine structure 104 is mounted to extend from handle 102. As used herein, the term "mount" includes join, unite, connect, couple, associate, insert, hang, hold, affix, attach, fasten, bind, paste, secure, bolt, screw, rivet, solder, weld, glue, form over, form in, layer, mold, rest on, rest against, abut, and other like terms. The phrases "mounted on", "mounted to", and equivalent phrases indicate any interior or exterior portion of the element referenced. These phrases also encompass direct mounting (in which the referenced elements are in direct contact) and indirect mounting (in which the referenced elements are not in direct contact, but are connected through an intermediate element). Elements referenced as mounted to each other herein may further be integrally formed together, for example, using a molding or thermoforming process as understood by a person of skill in the art. As a result, elements described herein as being mounted to each other need not be discrete structural elements. The elements may be mounted permanently, removably, or releasably unless specified otherwise.

Handle 102 may include a first wall 106, a transitional wall 107, and a second wall 108. First wall 106 may include a front face 110, a back face 200 (shown with reference to FIG. 2), a right side face 202 (shown with reference to FIG. 2), a top face 112, and a left side face 114. Second wall 108 may include a top face 204 (shown with reference to FIG. 2) and a bottom face 116. A sloped edge 600 (shown with reference to FIG. 6) provides a curved transition from top face 204 of second wall 108 to bottom face 116 of second wall 108.

Front face 110 of first wall 106 provides a first contact surface for handle 102. For example, a thumb print portion of a thumb of a user may be pressed against front face 110 of first wall 106 when divot repair tool 100 is used to repair a divot. Top face 204 of second wall 108 provides a second contact surface for handle 102. For example, a thumb tip of the thumb of the user may be pressed against top face 204 of second wall 108 when divot repair tool 100 is used to repair a divot. A finger of the user may be pressed against back face 200 of first wall 106 to hold divot repair tool 100 in a hand. Of course, divot repair tool 100 may be held using different combination of fingers and/or the thumb.

First wall 106 is mounted to second wall 108 at an angle. In the illustrative embodiment, the angle is approximately 90 degrees though other lesser or greater angles may be used. Front face 110 of first wall 106 extends generally perpendicular from top face 204 of second wall 108. Bottom face 116 of second wall 108 extends generally perpendicular from back face 200 of first wall 106. Transitional wall 107 is sloped between front face 110 of first wall 106 and top face 204 of second wall 108.

Right side face 202, top face 112, and left side face 114 form the edges between front face 110 of first wall 106 and back face 200 of first wall 106. In the illustrative embodiment, top face 112 of first wall 106 forms a curve between right side face 202 and left side face 114 though top face 112 of first wall 106 may be linear.

In the illustrative embodiment, right side face 202 and left side face 114 are linear though other shapes may be used. In the illustrative embodiment, top face 204 of second wall 108 and bottom face 116 of second wall 108 form a semicircle between right side face 202 and left side face 114 though other shapes may be used. Other shapes include full or partial circles, ellipses, polygons, etc.

Tine structure 104 may include a block of material 118, a trough wall 120, and a tapered wall 122. Block of material 118 includes a wall 119 and a bottom face 121. In the illustrative embodiment, wall 119 is disk shaped though other shapes may be used. Block of material 118 mounts tine structure 104 to bottom face 116 of second wall 108. Block of material 118 may provide additional support, strength, and/or rigidity to trough wall 120. Block of material 118 extends from bottom face 116 of second wall 108 in a generally perpendicular direction though other lesser or greater angles may be used. For example, block of material 118 may extend from bottom face 116 of second wall 108 at an angle between 45 and 90 degrees.

Trough wall 120 is mounted to block of material 118 though trough wall 120 may be mounted directly to bottom face 116 of second wall 108. Trough wall 120 is mounted between block of material 118 and tapered wall 122 or between bottom face 116 of second wall 108. Trough wall 120 may include an exterior surface 124, an interior surface 126, a right rim **128*r*, a left rim 128*l*, and a beveled rim 129. Tapered wall 122 may include a rim 130 that extends between right rim 128*r* and left rim 128*l*. Rim 130 slopes downward from an end of right rim 128*r* to a tip 131 and from an end of left rim 128*l* to tip 131. In an alternative embodiment, tine structure 104 may not include tapered wall 122**.

Beveled rim 129 forms a semicircle between right rim **128*r* and left rim 128*l* though other shapes may be used or beveled rim 129 may not be included. Trough wall 120 forms a trough with an open side bounded by right rim 128*r*, beveled rim 129, left rim 128*l*, and rim 130**.

Figure 2:
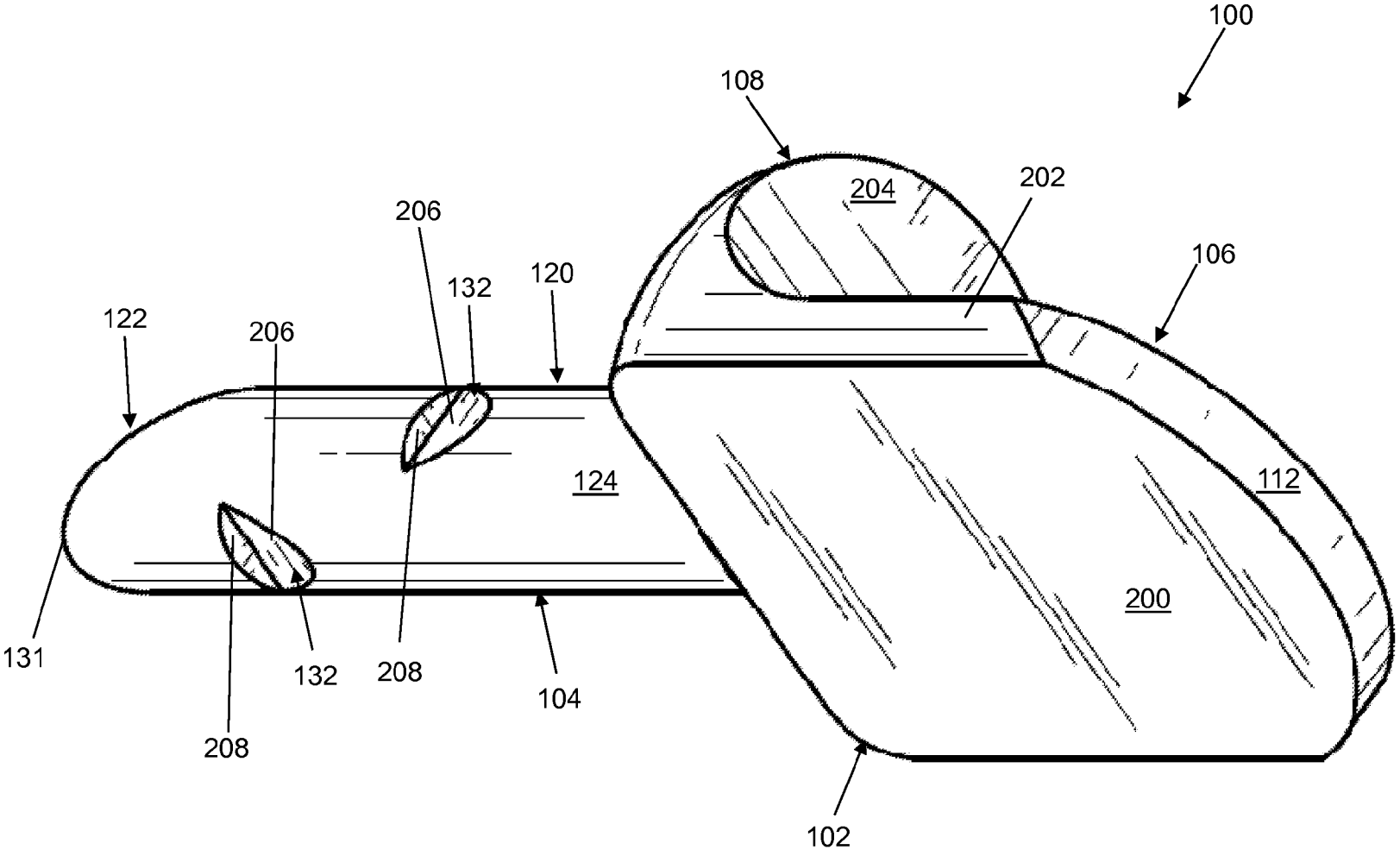
FIG. 2 depicts a back, right perspective view of the divot repair tool of FIG. 1 in accordance with an illustrative embodiment.

Exterior surface 124 of trough wall 120 may include one or more notches 132. With reference to FIG. 2, a back, right perspective view of divot repair tool 100 is shown in accordance with an illustrative embodiment. Each notch 132 may include a depression 206 and a ledge 208. Ledge 208 extends in a plane toward an interior of the trough and is open in a direction towards handle 102.

Figure 3:
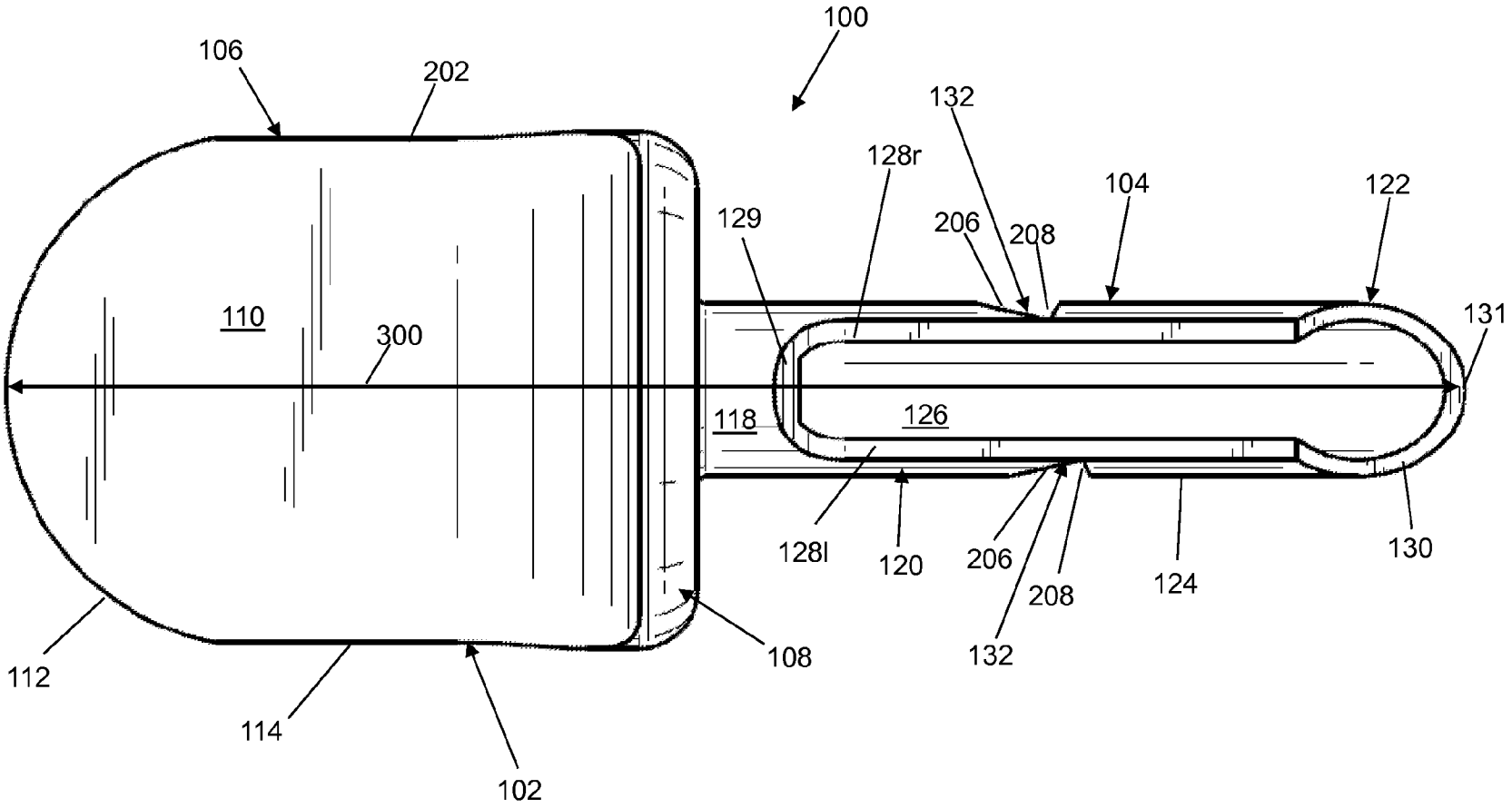
FIG. 3 depicts a front view of the divot repair tool of FIG. 1 in accordance with an illustrative embodiment.

With reference to FIG. 3, a front view of divot repair tool 100 is shown in accordance with an illustrative embodiment. A longitudinal axis 300 extends from tip 131 to an edge of top face 112 of first wall 106. A longitudinal length of handle 102 and tine structure 104 may be less than nine centimeters (cm). For example, the longitudinal length of handle 102 and tine structure 104 may be approximately eight cm.

Figure 4:
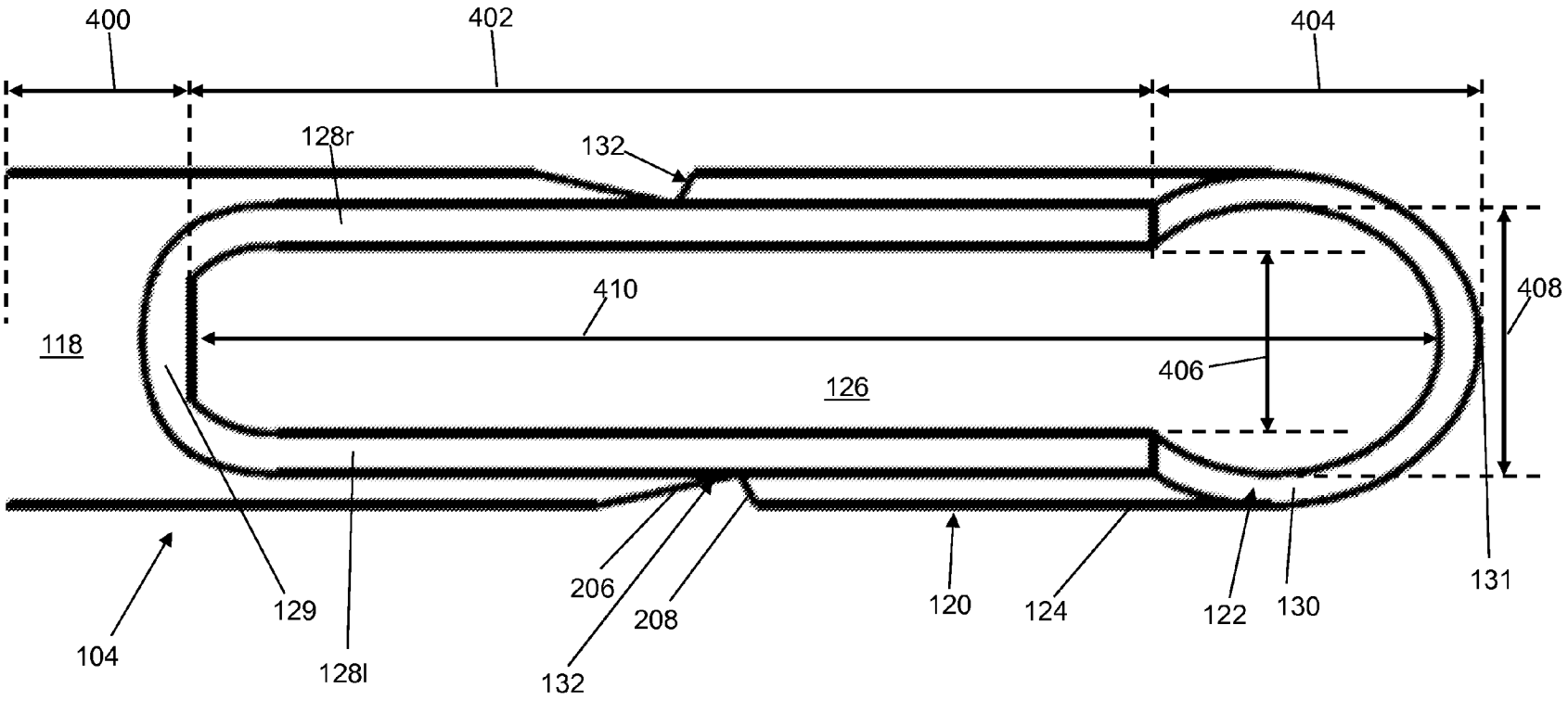
FIG. 4 depicts a zoomed view of a portion of the divot repair tool of FIG. 3 in accordance with an illustrative embodiment.

With reference to FIG. 4, a zoomed view of tine structure 104 is shown in accordance with an illustrative embodiment. A tine longitudinal axis 410 can be defined to extend from a first end of trough wall 120 adjacent block of material 118 to a second end of trough wall 120 adjacent tip 131. Tine longitudinal axis 410 may be parallel to longitudinal axis 300. A block longitudinal length 400 may be approximately 0.5 cm. A trough longitudinal length 402 may be less than four centimeters. A tip longitudinal length 404 may be less than one centimeter. For example, trough longitudinal length 402 may be approximately 2.8 cm, and tip longitudinal length 404 may be approximately 0.7 cm. A trough opening width 406 may be less than one centimeter. For example, trough opening width 406 may be approximately 0.5 cm. A maximum trough width 408 may be less than one centimeter. For example, maximum trough width 408 may be approximately 0.7 cm.

Figure 5:
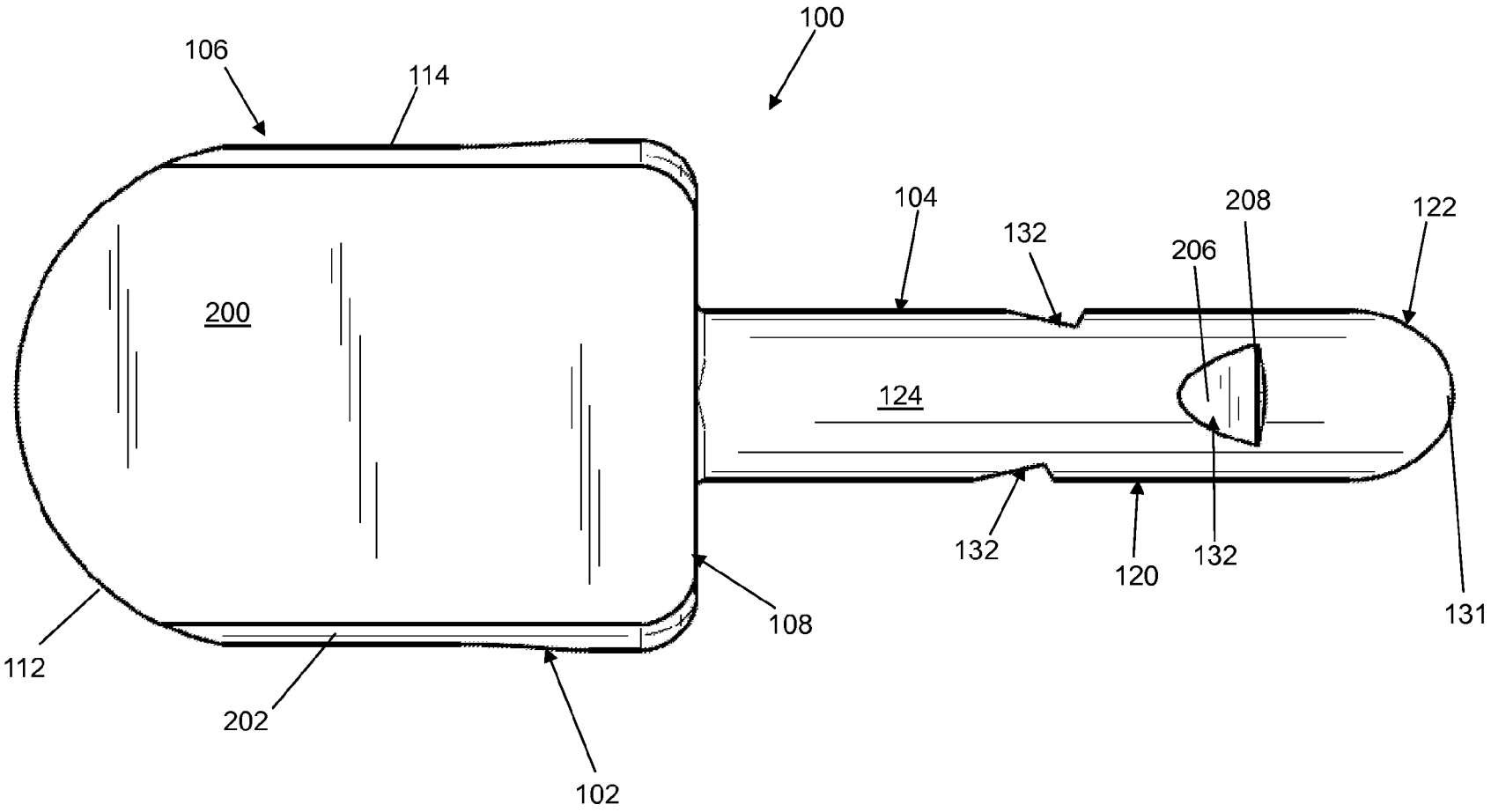
FIG. 5 depicts a back view of the divot repair tool of FIG. 1 in accordance with an illustrative embodiment.
Figure 6:
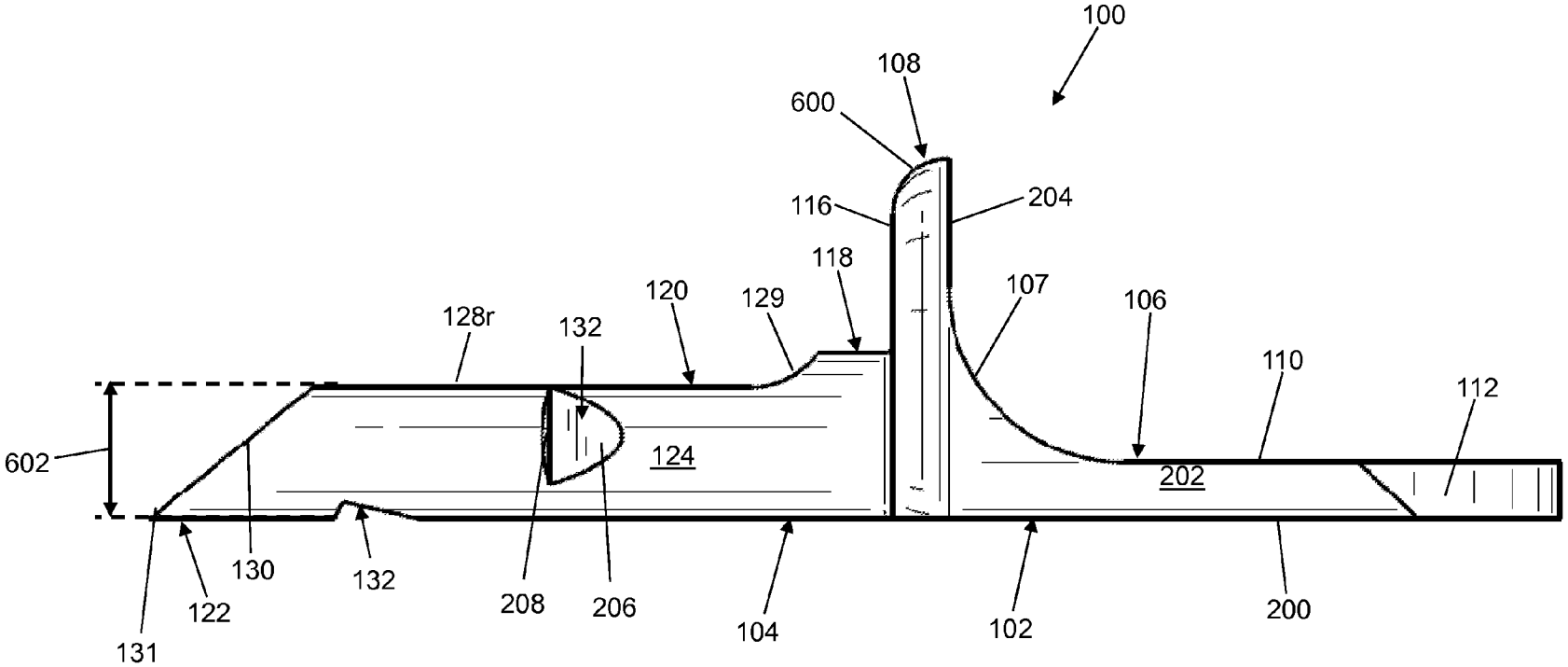
FIG. 6 depicts a right side view of the divot repair tool of FIG. 1 in accordance with an illustrative embodiment.

With reference to FIG. 5, a back view of divot repair tool 100 is shown in accordance with an illustrative embodiment. With reference to FIG. 6, a right side view of divot repair tool 100 is shown in accordance with an illustrative embodiment. A maximum trough height 602 may be less than one centimeter. For example, maximum trough height 602 may be approximately 0.7 cm.

Figure 8:
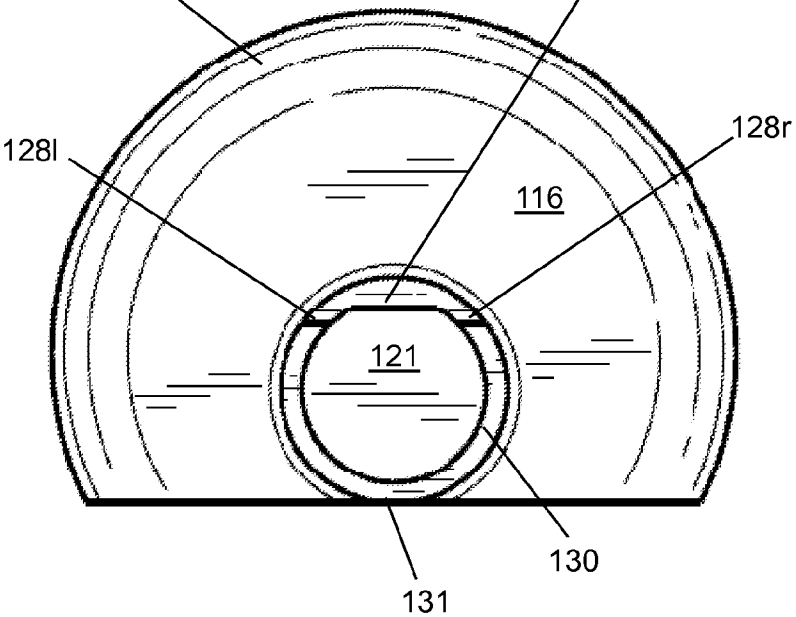
FIG. 8 depicts a bottom view of the divot repair tool of FIG. 1 in accordance with an illustrative embodiment.
Figure 7:
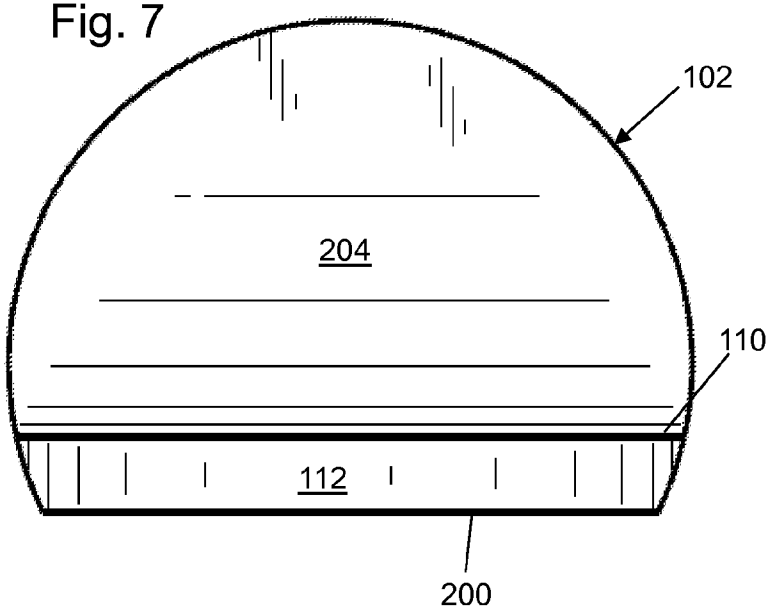
FIG. 7 depicts a top view of the divot repair tool of FIG. 1 in accordance with an illustrative embodiment.

With reference to FIG. 7, a top view of divot repair tool 100 is shown in accordance with an illustrative embodiment. With reference to FIG. 8, a bottom view of divot repair tool 100 is shown in accordance with an illustrative embodiment.

Figure 9:
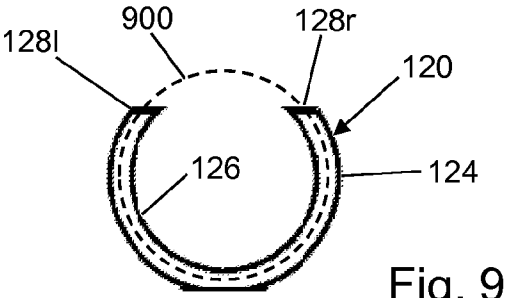
FIG. 9 depicts a cross sectional view of a trough wall of the divot repair tool of FIG. 1 in accordance with an illustrative embodiment.

With reference to FIG. 9, a cross sectional view of trough wall 120 is shown in accordance with an illustrative embodiment. A trough cross section can be defined in a plane perpendicular to tine longitudinal axis 410. Though shown in the illustrative embodiment as c-shaped or forming a portion of a circle, trough wall 120 may form any shaped channel. The trough cross section is further defined by an open side. For example, in the illustrative embodiment, the trough cross section forms a circle 900 that includes trough wall 120 though other shapes such as ellipsoidal and polygonal shapes may be used where circle 900 is an example of an ellipsoidal shape. Trough wall 120 forms at least 50% of circle 900 so that soil can be captured within trough wall 120 and removed from the divot when divot repair tool 100 is used. For example, in the illustrative embodiment, trough wall 120 forms approximately 75% of circle 900. In other illustrative embodiments, trough wall 120 may form half of circle 900 or may almost completely enclose the trough. For example, trough wall 120 may form up to 95% of circle 902 so that the captured dirt can be removed from within trough wall 120.

Figure 10:
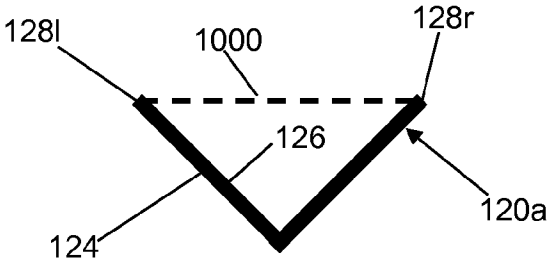
FIG. 10 depicts a cross sectional view of a second trough wall of the divot repair tool of FIG. 1 in accordance with an illustrative embodiment.

With reference to FIG. 10, a cross sectional view of a second trough wall 120*a* is shown in accordance with an illustrative embodiment. The trough cross section is further defined by second trough wall 120*a* and an open side 1000 that extends directly between right rim 128*r* and left rim 128*l*. The trough cross section forms a polygonal shape. Second trough wall 120*a* forms at least 60% of a perimeter of the polygonal shape. For example, in the illustrative embodiment of FIG. 10, the trough cross section forms a triangle.

Figure 11:
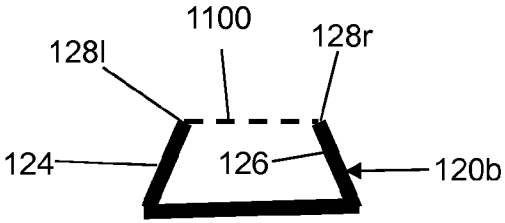
FIG. 11 depicts a cross sectional view of a third trough wall of the divot repair tool of FIG. 1 in accordance with an illustrative embodiment.

With reference to FIG. 11, a cross sectional view of a third trough wall 120*b* is shown in accordance with an illustrative embodiment. The trough cross section is further defined by third trough wall 120*b* and an open side 1100 that extends directly between right rim 128*r* and left rim 128*l*. The trough cross section forms a second polygonal shape. Third trough wall 120*a* forms at least 60% of the perimeter of the second polygonal shape.

Figure 12:
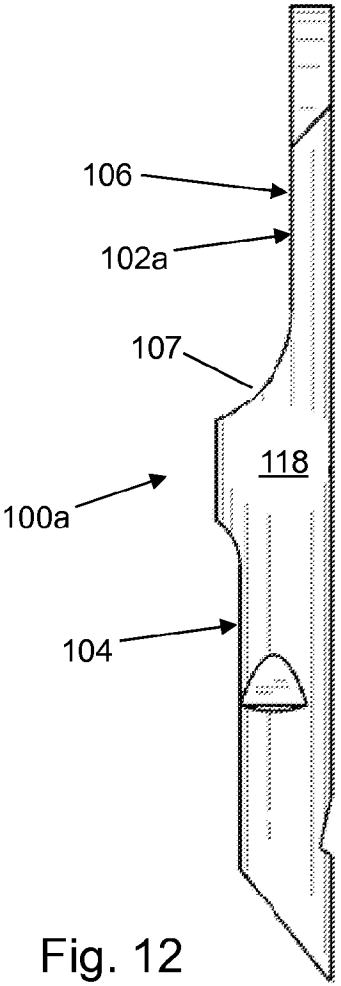
FIG. 12 depicts a right side view of a second divot repair tool in accordance with an illustrative embodiment.

With reference to FIG. 12, a right side view of a second divot repair tool 100*a* is shown in accordance with an illustrative embodiment. Second divot repair tool 100*a* may include a second handle 102*a* and tine structure 104. Second handle 102*a* may include first wall 106 and transitional wall 107, but does not include second wall 108. As another option, first wall 106 may be removed from second handle 102*a*.

Figure 13:
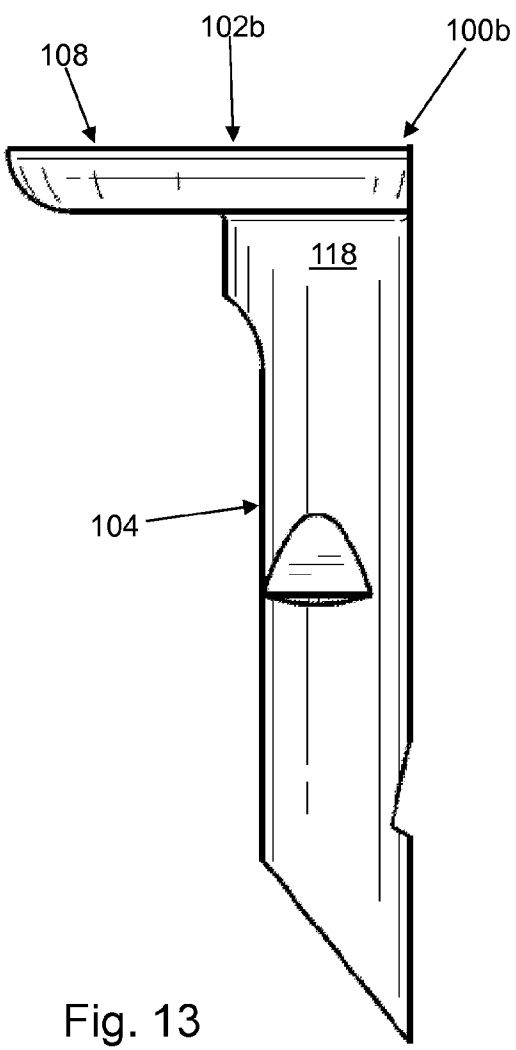
FIG. 13 depicts a right side view of a third divot repair tool in accordance with an illustrative embodiment.

With reference to FIG. 13, a right side view of a third divot repair tool 100*b* is shown in accordance with an illustrative embodiment. Third divot repair tool 100*b* may include a third handle 102*b* and tine structure 104. Third handle 102*b* may include second wall 108, but does not include first wall 106 or transitional wall 107.

Figure 14:
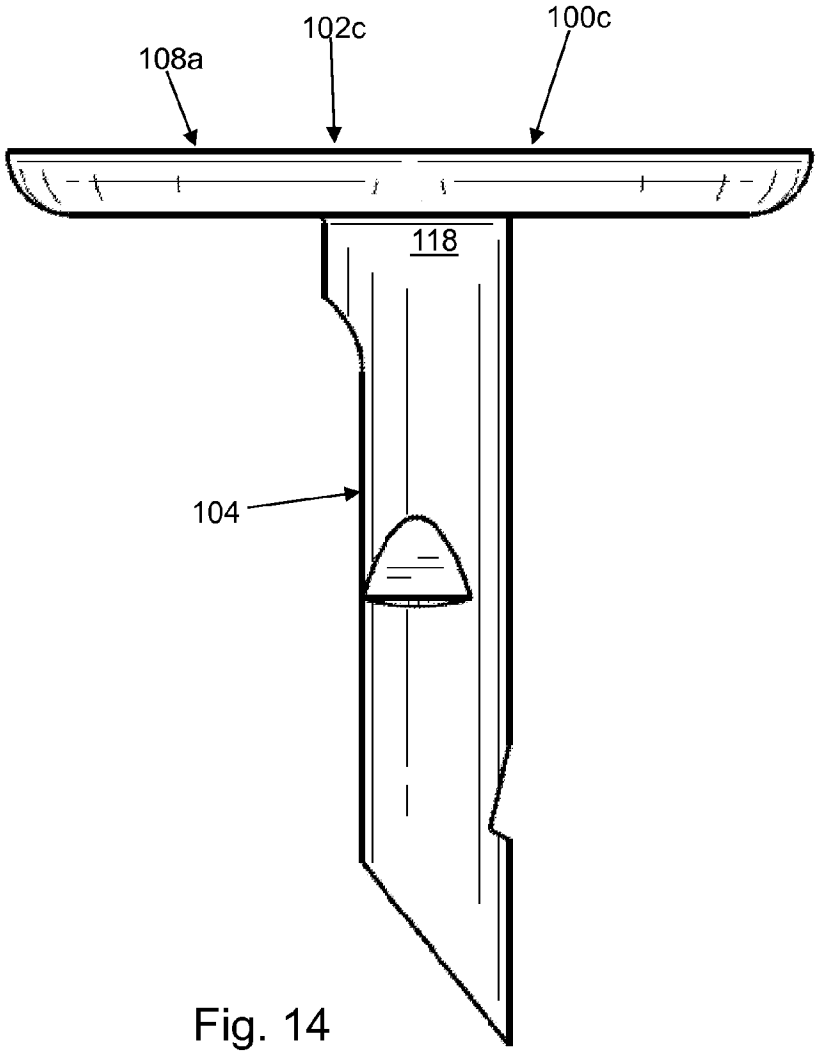
FIG. 14 depicts a right side view of a fourth divot repair tool in accordance with an illustrative embodiment.

With reference to FIG. 14, a right side view of a fourth divot repair tool 100*c* is shown in accordance with an illustrative embodiment. Fourth divot repair tool 100*c* may include a fourth handle 102*c* and tine structure 104. Fourth handle 102*c* may include third wall 108*a*, but does not include first wall 106 or transitional wall 107. Tine structure 104 extends from a center of third wall 108*a* instead of from an edge of second wall 108 as in divot repair tool 100. Third wall 108*a* is also circular instead of semicircular.

Figure 15:
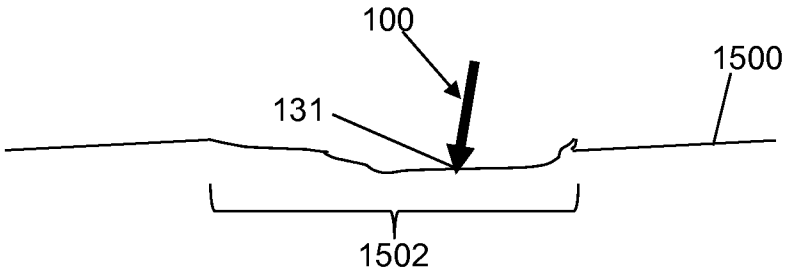
FIG. 15 depicts an insertion orientation of the divot repair tool when repairing a divot formed on a putting green surface in accordance with an illustrative embodiment.

With reference to FIG. 15, a portion of a putting green surface 1500 is shown in accordance with an illustrative embodiment. A divot 1502 is formed in putting green surface 1500. Divot repair tool 100 is held in a hand of a user using handle 102 (second handle 102*a*, third handle 102*b*, fourth handle 102*c*). For example, a thumb or a finger(s) of a user is (are) pressed against first wall 106, transitional wall 107, and/or second wall 108. Tip 131 of divot repair tool 100 (second divot repair tool 100*a*, third divot repair tool 100*b*, fourth divot repair tool 100*c*) is inserted by a user into divot 1502. The angle of insertion may vary, but typically is between approximately 60 degrees and 90 degrees (vertical). With reference to FIG. 15, an insertion orientation of divot repair tool 100 is shown in accordance with an illustrative embodiment. Divot repair tool 100 may be inserted into divot 1502 at one or more locations depending on a size of the damaged area to sufficiently decompact the soil.

Figure 16:
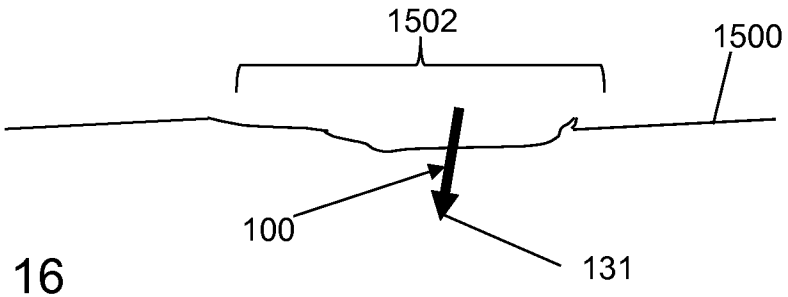
FIG. 16 depicts an inserted position of the divot repair tool when repairing the divot formed on the putting green surface in accordance with an illustrative embodiment.

With reference to FIG. 16, an inserted position of divot repair tool 100 is shown in accordance with an illustrative embodiment. After insertion or while inserting divot repair tool 100, the user may rotate divot repair tool 100 so that soil below divot 1502 is captured within trough wall 120. After capturing soil within trough wall 120, divot repair tool 100 is extracted from divot 1502 at an angle similar to the angle of insertion leaving a cored hole in divot 1502 to an insertion depth defined by tip longitudinal length 404 and trough longitudinal length 402. A core of soil captured within trough wall 120 may be removed by shaking divot repair tool 100 or inserting an object in the open side of trough wall 120 and swiping the object within the open side towards tip 131. For example, the object may be a golf tee. The cored hole allows nutrients, water, and air to flow to a root system of the grass forming putting green surface 1500 to allow the grass to repair itself naturally within divot 1502. A pellet of sand, fertilizer, and/or grass seed can be inserted into the cored hole to further facilitate repair of divot 1502. The one or more notches 132 loosen and lift soil around a periphery of the cored hole to decompact the soil below divot 1502.

Figure 17:
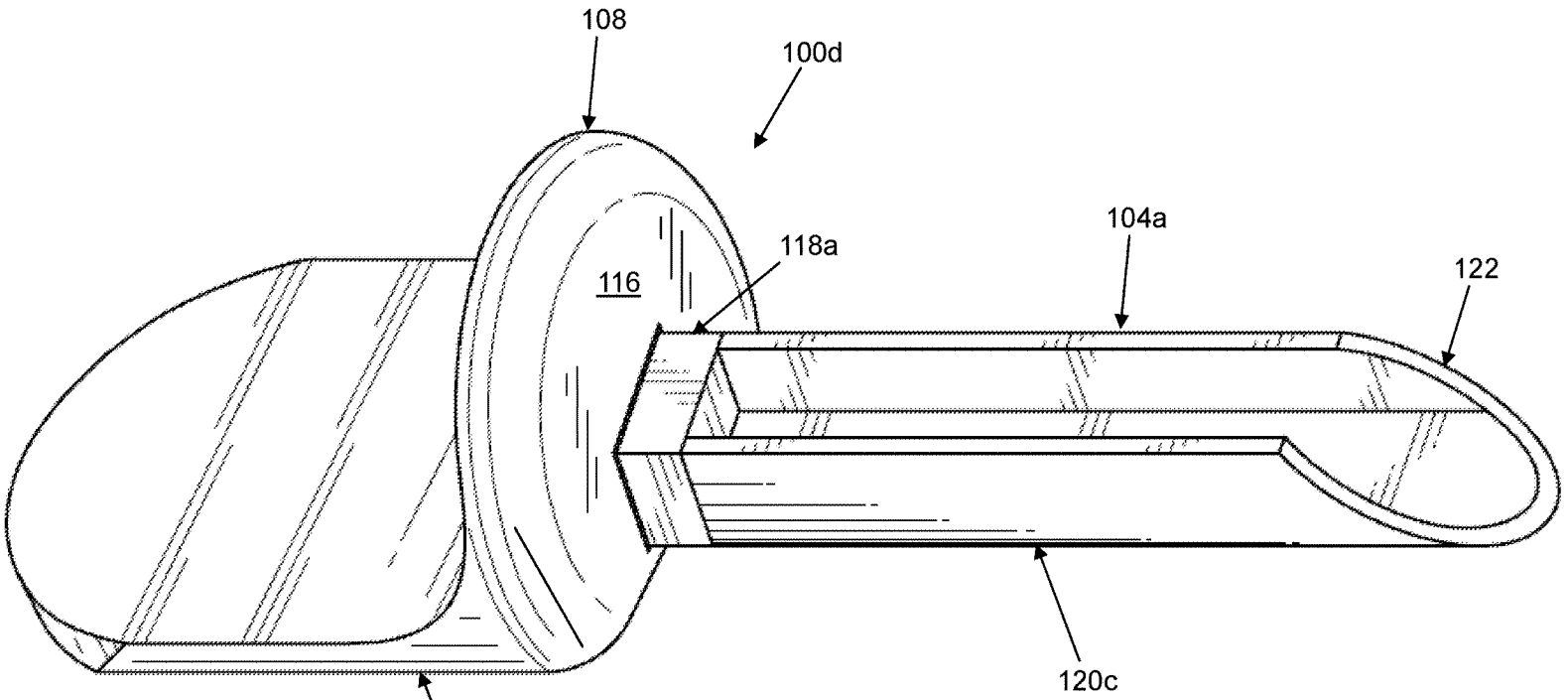
FIG. 17 depicts a front perspective view of a fifth divot repair tool in accordance with an illustrative embodiment.

With reference to FIG. 17, a front perspective view of a fifth divot repair tool 100*d* is shown in accordance with an illustrative embodiment. Fifth divot repair tool 100*d* may include handle 102 and a second tine structure 104*a*. Second tine structure 104*a* extends from bottom face 116 of second wall 108 as in divot repair tool 100. Second tine structure 104*a* may include a second block of material 118*a*, a fourth trough wall 120*c*, and tapered wall 122. Fourth trough wall 120*c* has a polygonal shaped trough cross section.

The word "illustrative" is used herein to mean serving as an example, instance, or illustration. Any aspect or design described herein as "illustrative" is not necessarily to be construed as preferred or advantageous over other aspects or designs. Further, for the purposes of this disclosure and unless otherwise specified, "a" or "an" means "one or more". Still further, using "and" or "or" in the detailed description is intended to include "and/or" unless specifically indicated otherwise.

The foregoing description of illustrative embodiments of the disclosed subject matter has been presented for purposes of illustration and of description. It is not intended to be exhaustive or to limit the disclosed subject matter to the precise form disclosed, and modifications and variations are possible in light of the above teachings or may be acquired from practice of the disclosed subject matter. The embodiments were chosen and described in order to explain the principles of the disclosed subject matter and as practical applications of the disclosed subject matter to enable one skilled in the art to utilize the disclosed subject matter in various embodiments and with various modifications as suited to the particular use contemplated.

What is claimed is:

1. A method of repairing divot on a golf green, the method comprising:

holding a golf green divot repair tool in a hand using a handle of the golf green divot repair tool, wherein the handle comprises a first wall comprising a first planar contact face; and a second wall mounted to extend in an up direction from the first wall, wherein the second wall comprises a second planar contact face and a third face that faces opposite the second planar contact face, wherein the second planar contact face extends perpendicular to the first planar contact face;

wherein the golf green divot repair tool further includes a tine structure that includes a trough wall forming a trough, the trough wall mounted to the handle at a first end of the trough wall; and a tapered wall mounted to extend to a tip from a second end of the trough wall, wherein the second end and the first end are on opposite ends of the trough;

inserting the tip directly into a divot on a golf green until the trough wall is at least partially below a surface of the divot;

rotating the inserted golf green divot repair tool to trap soil in the trough wall;

withdrawing the golf green divot repair tool from the divot with the trapped soil; and discarding the trapped soil.

2. The method of claim 1, wherein a trough cross section is defined in a plane parallel to the second planar contact face to include the trough wall and the open side, wherein the open side of the trough is in the up direction, wherein the trough cross section forms a partially enclosed shape, wherein the trough wall of the trough cross section traps soil within the trough when inserted in the divot.

3. The method of claim 2, wherein the partially enclosed shape forms an ellipsoid, wherein the trough wall of the trough cross section forms at least 50% of the ellipsoid to trap the soil within the trough.

4. The method of claim 3, wherein the ellipsoid is a circle.

5. The method of claim 3, wherein the trough wall of the trough cross section forms from 50% to 95% of the ellipsoid.

6. The method of claim 1, wherein the handle and the tine structure are molded together as a single piece of plastic.

7. The method of claim 1, wherein a notch is formed in an exterior surface of the trough wall.

8. The method of claim 7, wherein the notch includes a ledge that extends in the plane approximately parallel to the second planar contact face toward an interior of the trough.

9. The method of claim 1, wherein a block of material is mounted between the first end of the trough wall and the third face of the handle.

10. The method of claim 1, wherein a longitudinal length of the handle and the tine structure is less than nine centimeters.

11. The method of claim 1, wherein a longitudinal length of the trough from the first end of the trough wall to the tip is less than four centimeters.

12. The method of claim 2, wherein a maximum width of the trough cross section is less than one centimeter.

13. The method of claim 8, wherein the notch further includes a depression that extends lengthwise along the exterior surface of the trough wall from a first portion of the trough wall to the ledge so that the ledge is open in a direction towards the handle.

14. The method of claim 1, wherein the handle further comprises a transitional wall sloped between the first planar contact face and the second planar contact face.

15. The method of claim 2, wherein the partially enclosed shape forms a polygon, wherein the trough wall of the trough cross section forms at least 60% of the polygon to trap the soil within the trough.

16. The method of claim 1, wherein an angle of insertion is between 60 degrees and approximately 90 degrees.

17. The method of claim 1, wherein the trough has an open side, and the trough wall is mounted to extend perpendicular to the third face of the handle in a direction opposite the second planar contact face at the first end of the trough wall.

18. The method of claim 17, wherein a trough cross section is defined in a plane parallel to the second planar contact face to include the trough wall and the open side, wherein the open side of the trough is in the up direction, wherein the trough cross section forms a partially enclosed shape that is a polygon, wherein the trough wall of the trough cross section forms at least 60% of the polygon to trap the soil within the trough.

19. The method of claim 17, wherein a trough cross section is defined in a plane parallel to the second planar contact face to include the trough wall and the open side, wherein the open side of the trough is in the up direction, wherein the trough cross section forms a partially enclosed shape that is an ellipsoid, wherein the trough wall of the trough cross section forms at least 50% of the ellipsoid to trap the soil within the trough.

* * * * *